US008220687B2

(12) United States Patent
Yamamoto et al.

(10) Patent No.: US 8,220,687 B2
(45) Date of Patent: Jul. 17, 2012

(54) NAILING DRIVE GUIDE MECHANISM FOR NAILING MACHINE

(75) Inventors: Hiroki Yamamoto, Tokyo (JP); Michiaki Adachi, Tokyo (JP); Terufumi Hamano, Tokyo (JP); Tatsushi Ogawa, Tokyo (JP); Kouji Kubo, Tokyo (JP); Yasunori Aihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 1165 days.

(21) Appl. No.: 10/548,175

(22) PCT Filed: Apr. 21, 2004

(86) PCT No.: PCT/JP2004/005698

§ 371 (c)(1),
(2), (4) Date: Jan. 24, 2006

(87) PCT Pub. No.: WO2004/098838

PCT Pub. Date: Nov. 18, 2004

(65) Prior Publication Data

US 2006/0157527 A1 Jul. 20, 2006

(30) Foreign Application Priority Data

May 8, 2003 (JP) ..... P.2003-130335

(51) Int. Cl.
*B25C 1/04* (2006.01)

(52) U.S. Cl. ..... 227/120; 227/8

(58) Field of Classification Search ..... 227/8, 32, 227/110, 119, 123, 120
See application file for complete search history.

(56) References Cited

U.S. PATENT DOCUMENTS

| | | | | |
|---|---|---|---|---|
| 5,238,167 | A * | 8/1993 | Howard et al. | 227/110 |
| 6,279,808 | B1 | 8/2001 | Larsen | 227/119 |
| 6,789,718 | B2 * | 9/2004 | Canlas et al. | 227/130 |
| RE39,567 | E * | 4/2007 | Larsen | 227/119 |

FOREIGN PATENT DOCUMENTS

| | | |
|---|---|---|
| JP | 52-43178 | 4/1977 |
| JP | A-55-157484 | 12/1980 |
| JP | 56-48482 U | 4/1981 |
| JP | A-06-190745 | 7/1994 |
| JP | 7-27090 Y | 6/1995 |
| JP | 2002-66950 | 3/2002 |
| JP | 2002-219663 | 8/2002 |

* cited by examiner

*Primary Examiner* — Paul R Durand
*Assistant Examiner* — Nathaniel Chukwurah
(74) *Attorney, Agent, or Firm* — Morgan, Lewis & Bockius LLP

(57) ABSTRACT

A ratchet member 23, which is provide with a slope 24 for guiding a tip end of a nail inclined to a rear side of an ejection opening 7 into the ejection openings 7 and 16, and a guide surface 25 for guiding the tip end of a nail to the center of each of the ejection openings 7 and 16, is provided on a rear side of ejection openings 7 and 16 and urged so that a guide surface 25 of the ratchet member 23 enters the ejection openings 7 and 16.

10 Claims, 17 Drawing Sheets

NAILING DRIVE GUIDE MECHANISM FOR NAILING MACHINE

TECHNICAL FIELD

The present invention relates to a nailing machine that hammers a nail supplied into an ejection opening of a nose portion into a member to be nailed by a driver impactively driven by a power of compressed air or the like. More particularly, the present invention relates to a nail hammering guide mechanism that is provided in the nailing machine and is enabled to surely guide a nail, which is hammered out of the ejection opening by the driver, toward the member to be nailed.

BACKGROUND ART

In a conventional nailing machine, a cylindrical ejection opening is formed in a nose portion. In a rear side part of the ejection opening, an opening through which connected nails are supplied into the ejection opening is formed. A foremost one of the connected nails supplied from the opening into the ejection opening is hammered out from the ejection opening by a driver reciprocatively driven in the ejection opening. The inside diameter of the ejection opening of the nose portion is set at a maximum diameter of a head portion of a largest size one of nails used in the nailing machine. The head portion of the nail, which is hammered out from the ejection opening by the driver, is guided by the inner wall surface of the ejection opening. A tip end portion of the nail is in a free condition. When the nail supplied into the ejection opening is hammered by the driver, the tip end portion of the nail may be inclined by resistance, which is caused by disconnecting the nail from the subsequent one of connected nails, to the rear side in the ejection opening. Thus, the nail may be hammered out in such a state that the tip end portion of the nail is inclined rearwardly, and may fly out from an opening, opened rearwardly from the ejection opening, to the rear of the nose portion.

To solve this phenomenon, a conventional nailing machine is configured so that a slope, which is rearwardly and upwardly inclined, is formed integrally with the bottom portion of an opening, which is formed to be opened rearwardly and to introduce a nail to a cylindrical ejection opening. The tip end portion of the nail hammered out rearwardly contacts with the slope to thereby guide the tip end portion of the nail into the ejection opening. Thus, the conventional nailing machine prevents a nail, which is hammered out from the ejection opening by the driver, from flying out to the rear of the ejection opening. However, the tip end portion of the nail, which is hammered by the driver at the head portion thereof and is discharged from the ejection opening, can freely move in the ejection opening. Thus, sometimes, the nail is freely inclined, so that the nail is hammered out in an inclined state from the ejection opening, and that the nail is tiltingly driven into a member. Especially, in the case of a nail that is small in diameter of the head portion and that is short in length of a shank, an angle of inclination of the nail in the ejection opening is large. This increases tendency to drive a tilted nail into a member.

Further, JP-Y-07-027090 proposes the following technique. Paired holes are formed in an end part of a cylindrical nose portion, in which an ejection opening is formed, to face a cylindrical surface. Paired claw members respectively urged by springs, which cause tip end portions of the claw members to enter the ejection opening through the holes, are provided on the nose portion to be able to swing. The bottom surface of the head portion of the nail is held by the claw members to thereby bring the top surface of the head portion of the nail, which is driven out by being hammered with the driver, into intimate contact with the bottom surface of the driver. Also, the shank of the nail to be hammered is aligned with a line parallel to an axis line of the nose portion. Consequently, the tip end of a nail is placed at the center of the ejection opening, so that the nail is hammered out from the ejection opening.

Meanwhile, in a nailing machine adapted so that a piston is driven by using compressed air as a power source, and that a nail supplied in an ejection opening is hammered out by a driver connected to the piston, a reaction to an operation of actuating the piston by using compressed air is caused in a main body of the nailing machine. This causes a phenomenon that the nailing machine is reacted in a direction opposite to a direction in which a nail is hammered. Thus, simultaneously with the reaction of hammering out the nail from the ejection opening, the end portion of the nose portion frontwardly moves as a reaction. There is tendency that the end portion of the ejection opening is frontwardly moved by the reaction of the nailing machine when a nail is driven into a member to be nailed in a state in which the tip end of the nail is placed on a back side of the bottom portion of the ejection opening, or in which the tip end of the nail is placed at the center of the ejection opening. Also, a nail is sometimes driven thereinto in a state in which the head portion of the nail is frontwardly inclined.

As described above, the shank of the nail to be hammered is aligned with a line parallel to the axis line of the nose portion in by the pair of claw members pressed by the springs in the aforementioned conventional nailing machine. However, in a case where nails are driven into nail hammering holes formed in predetermined places of a metal building member, since the nail is driven by placing the tip end of the nail at the center position of the nose portion, this conventional nailing machine has drawbacks that it is difficult to align the center position of the end portion of the ejection opening of the nose portion with each of the nail holes. Thus, it is impossible to drive a nail into the nail hole of the metal building member.

Further, in the conventional nailing machine, in which the claw members adapted to enter and exit the ejection opening are formed, a nail hammered out tiltingly from the opening formed in the rear side of the nose portion cannot be guided into the ejection opening. Thus, it is necessary to form an additional structure adapted to guide the tip end of a nail tilted rearwardly.

DISCLOSURE OF THE INVENTION

Problems to be solved by the invention are to eliminate the drawbacks of the conventional machine, and to provide a nail hammering guide mechanism for a nailing machine, which is enabled to prevent a nail, which is hammered by a driver in an ejection opening, from flying out rearwardly from the ejection opening, and which is also enabled to prevent a nail from being hammered in a state, in which the head portion of the nail is frontwardly tilted, even when an end portion of the ejection opening is frontwardly moved by a reaction of the nailing machine, and in which is also enabled to hammer a nail into a nail hole, which is formed in a metal building member, at the end portion of the ejection opening.

To solve the problems, according to an aspect of the invention, there is provided a nail hammering guide mechanism for a nailing machine, having a driver activated by a driving power of compressed air, and a nose portion, in which a hollow ejection opening adapted to slidably guide the driver, wherein a nail supplied to the ejection opening of the nose portion is hammered out by the driver from the ejection opening. In this nail hammering guide mechanism, a ratchet member having a slope adapted to guide an end portion of a nail, which is inclined rearwardly from the ejection opening, into the ejection opening, and also having a guide surface adapted to guide an end portion of the nail to a center of the ejection opening is formed in the rear of the ejection opening and is urged so that the guide surface of the ratchet member enters the ejection opening.

More preferably, the ratchet member is disposed in a nose top slidably supported with respect to the nose portion and has an ejection opening aligned with the ejecting opening of the nose portion.

More preferably, the ratchet member is disposed in the nose portion in which the ejection opening is formed.

According to another aspect of the invention, there is provided a nailing machine having a driver activated by a driving power of compressed air, and a nose portion, in which a hollow ejection opening adapted to guide the driver slidably, wherein a nail supplied in the ejection opening of the nose portion is hammered out by the driver from the ejection opening. In this nailing machine, a ratchet member having a slope adapted to guide an end portion of a nail, which is inclined rearwardly from the ejection opening, into the ejection opening, and also having a guide surface adapted to guide an end portion of the nail to a center of the ejection opening is formed in the rear of the ejection opening and is urged so that the guide surface of the ratchet member enters the ejection opening. Moreover, a guide projection adapted to be insertable into a metal building fitting is formed at the bottom portion of a front wall of the ejection opening to project downwardly. An end portion of a nail is hammered out along the guide projection.

Furthermore, according to still another aspect of the invention, there is provided a nailing machine having a driver activated by a driving power of compressed air, and a nose portion, in which a hollow ejection opening adapted to guide the driver slidably, wherein a nail supplied in the ejection opening of the nose portion is hammered out by the driver from the ejection opening. In this nailing machine, a ratchet member having an upper slope, which is adapted to guide an end portion of a nail inclined rearwardly from the ejection opening into the ejection opening, and also having a lower slope adapted to guide the end portion of the nail, which is guided into the ejection opening, to a front wall of the ejection opening, is formed in the rear of the ejection opening so that the upper slope and the lower slope are formed to extend continuously, that the upper slope of the ratchet member is always disposed in the rear of the ejection opening, and that the lower slope is capable of entering and exiting the ejection opening and is urged in a direction, in which the lower slope enters the ejection opening, and is disposed in the rear of the ejection opening.

BRIEF DESCRIPTION OF THE DRAWINGS

FIG. 16(*a*) shows an initial operating state. FIG. 16(*b*) shows an operating state in which the hammering operation further proceeds. FIG. 16(*c*) shows an operating state in which the hammering operation is completed.

FIG. 17(*a*) shows an initial operating state. FIG. 17(*b*) shows an operating state in which the hammering operation further proceeds. FIG. 17(*c*) shows an operating state in which the hammering operation is completed.

Figure 1:
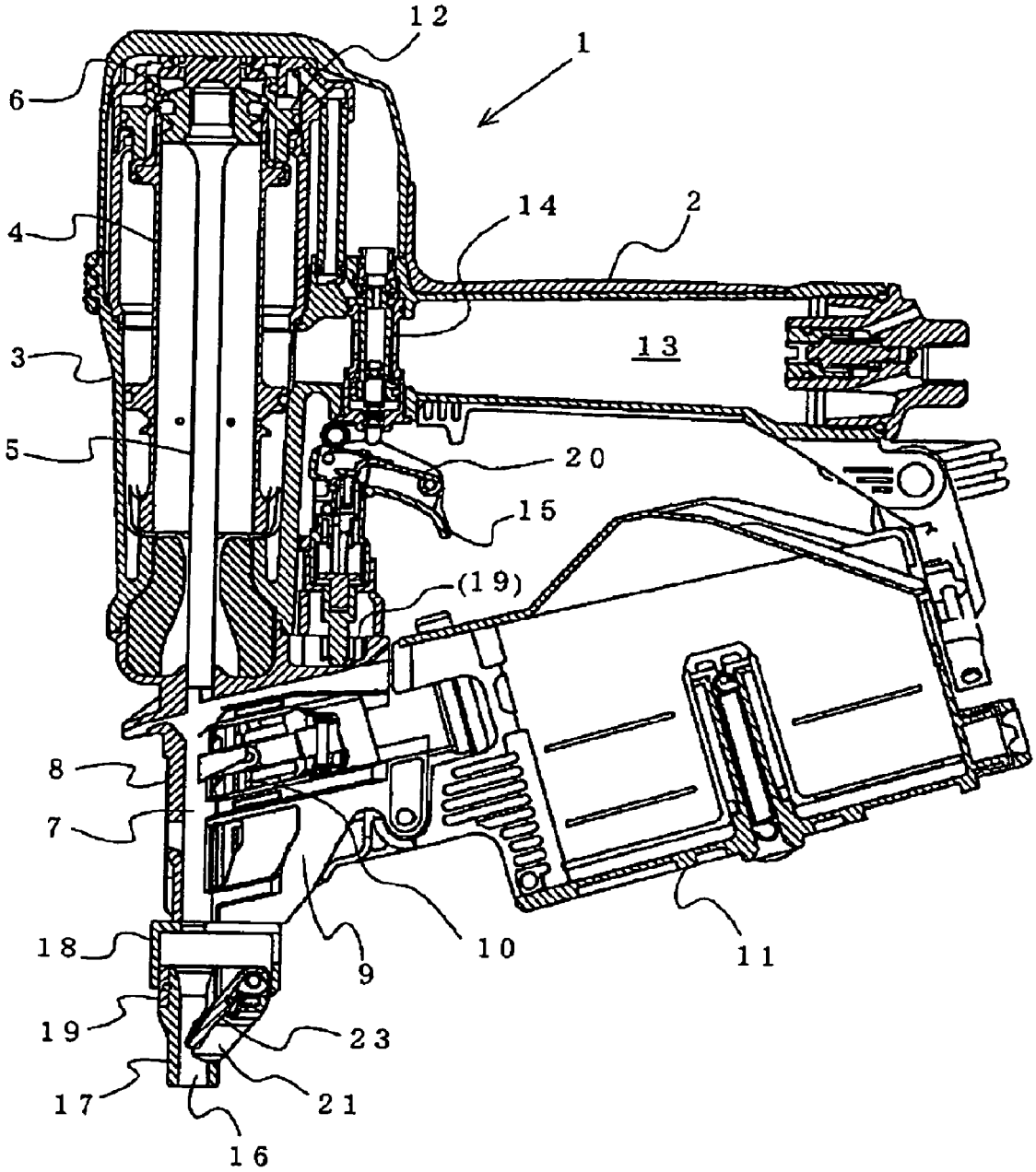
FIG. 1 is a longitudinally cross-sectional view of a nailing machine in which a nail hammering guide mechanism according to a first embodiment of the invention is implemented.

Incidentally, in the figures, reference numeral 1 denotes a nailing machine. Reference numeral 5 denotes a driver. Reference numeral 7 denotes an ejection opening. Reference numeral 8 denotes a nose portion. Reference numeral 16 denotes an ejection opening. Reference numeral 17 denotes a nose top. Reference numeral 18 denotes a contact holder. Reference numeral 23 denotes a ratchet member. Reference numeral 24 denotes a slope. Reference numeral 25 denotes a guide surface. Reference numeral 26 denotes a cylindrical surface. Reference numeral 27 denotes a spring.

BEST MODE FOR CARRYING OUT THE INVENTION

Hereinafter, a mode for carrying out the invention is described according to embodiments shown in the accompanying drawings.

First Embodiment

FIG. 1 shows a nailing machine 1 having a nail hammering guide mechanism according to an embodiment of the invention. A hammering cylinder 4 is disposed in a hollow housing 3 formed integrally with a grip portion 2. A hammering piston 6, whose bottom surface is connected to a driver 5 adapted to hammer a nail, is slidably accommodated in the hammering cylinder 4. A nose portion 8, in which a hollow ejection opening 7 is formed, is attached to a lower portion of the housing 3. The driver 5 is slidably guided in the ejection opening 7 of the nose portion 8. An opening, through which nails connected together are introduced into the ejection opening 7, is formed in a rear side of the ejection opening 7 of the nose portion 8. A nail supply guide 9 is provided continuously to one of side edges of the opening. A nail supply mechanism 10 disposed along the nail supply guide 9 serially supplies connected nails, which are provided in a magazine 11, into the ejection opening 7 of the nose portion 8.

A main valve 12 is disposed at the top of the hammering cylinder 4. The main valve 12 selectively connects the inside of the hammering cylinder 4 to the inside of an air chamber 13, which is formed in the grip portion 2 connected to an compressed air supply source, or to an exhaust port. The main valve 12 connects the hammering cylinder 4 to the air chamber 13 to thereby introduce compressed air, which is provided in the air chamber 13, into the hammering cylinder 4. Thus, the hammering piston is driven, so that the driver connected to the hammering piston 6 hammers out a nail, which is supplied into the ejection opening 7. A trigger valve 14 adapted to control the main valve 12 is disposed at the base part of the grip portion 2. The trigger valve 14 is operated by operating a manually-operatable trigger lever 15 to cause the main valve 12 to selectively connect the hammering cylinder 4 to the air chamber 13 or to the exhaust port.

A hollow nose top 17, in which an ejection opening 16 continued from the ejection opening 7 formed in the nose portion 8 is formed, is disposed at an end of the nose portion 8 in which the ejection opening 7 is formed. This nose top 17 is held by a contact holder 18 formed at the end of the nose portion 8 so that the nose top 17 can slide along a direction of an axis line of the ejection opening 7. The top of a contact arm 19 connected to the nose top 17 is disposed in the vicinity of the trigger lever 15. This contact arm 19 performs an operation of turning a contact lever 20 swingably supported by the trigger lever 15. Thus, the nailing machine is activated by enabling the trigger valve 14 to be operated by operating the trigger lever 15.

Figure 2:
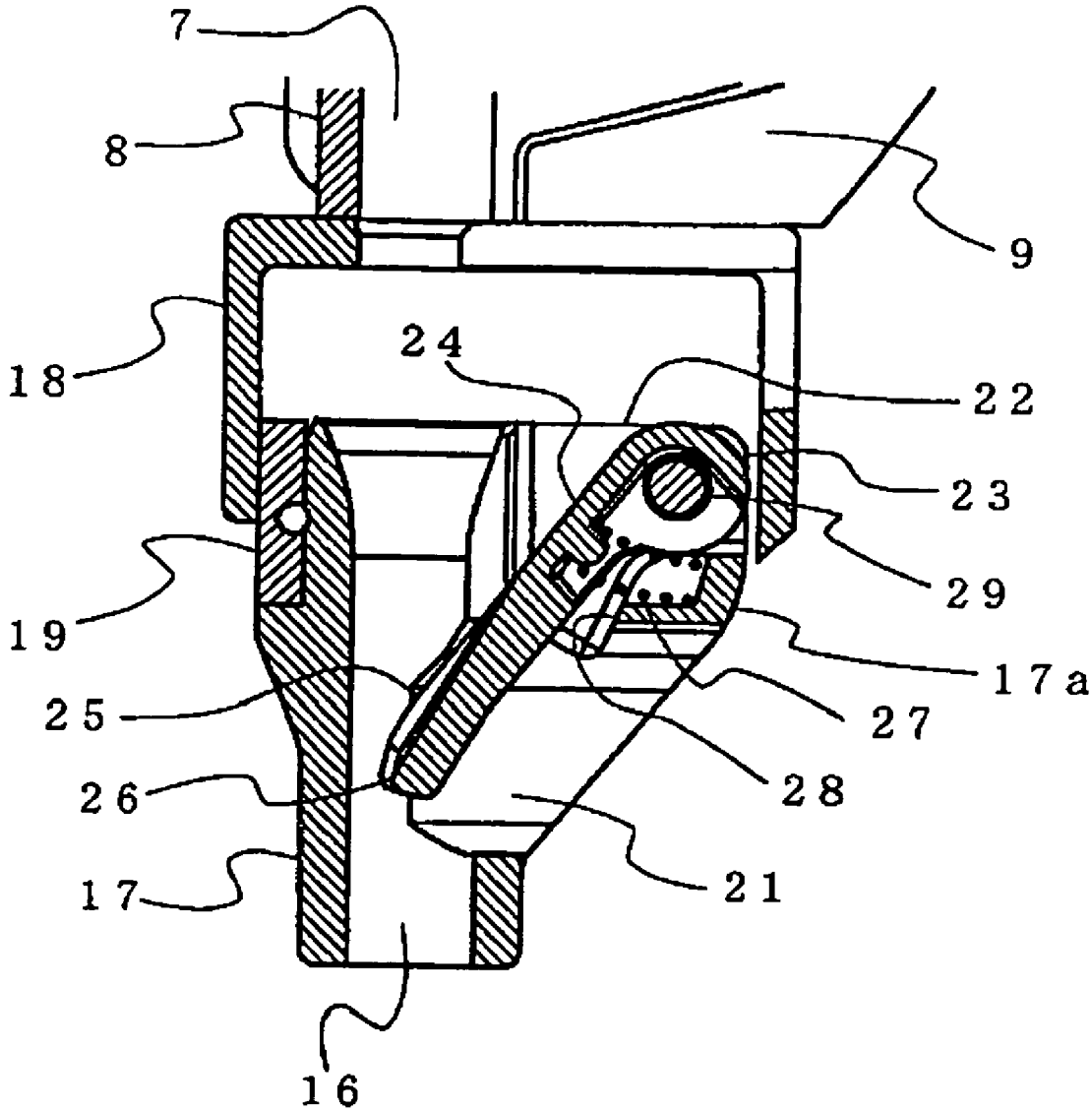
FIG. 2 is a longitudinal cross-sectional view of a primary part of the nailing machine shown in FIG. 1.
Figure 3:
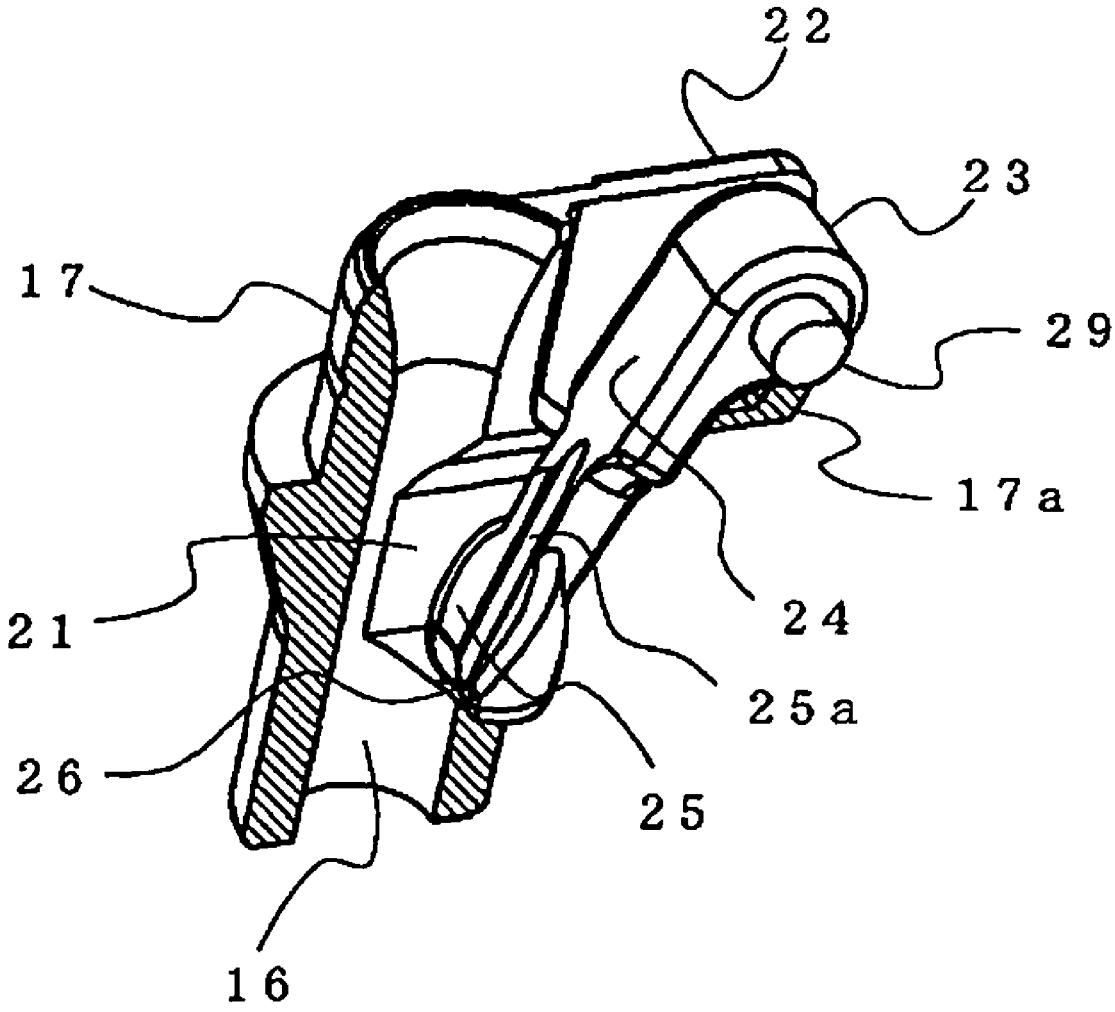
FIG. 3 is a partially cross-sectional perspective view of a primary part of the nailing machine shown in FIG. 1.

As shown in FIGS. 2 and 3, the nose top 17 is formed into a cylindrical shape. An opening 21 aligned with the nail supply guide 9 formed in the nose portion 8 is formed at a rearward upper part of this nose top 17. Side walls 22 extending rearwardly along both side of the opening 21, respectively, are formed. A ratchet member 23, which is adapted so that a nail hammered out from the ejection opening 7 of the nose portion 8 between both the side walls 22 is guided into the ejection opening 16 of the nose top 17 and that the shank of the nail is pressed against a front wall of the ejection opening, is provided by being turnably supported at the top portion thereof by both the side walls 22.

A support shaft 29 fitted between both the side walls 22 is passed through the top portion of the ratchet member 23, so that the ratchet member 23 is turnable around the shaft 29. Also, the ratchet member 23 is held in an inclined state so that the bottom portion thereof can enter the ejection opening 16 of the nose stop 17 through the opening 21. On the top surface of the ratchet member 23, the following surfaces 24, 25, and 26 are formed to extend continuously and downwardly. That is, a slope 24 is formed flat to contact with a tip end of a nail, which is rearwardly inclined in the ejection opening 7 of the nose portion 8 and hammered therefrom, and to guide the tip end portion of the nail into the ejection opening 16 of the nose top 17. A guide surface 25 is formed like a circular conical surface, which guides the tip end and the shank of a nail to the center position in the direction of width of the ejection opening 16 of the nose top 17. Also, a cylindrical surface 26 is formed to be the same as that of the ejection opening 16. Additionally, a guide groove 25*a* is formed in the guide surface 25 to guide the tip end portion of a nail to the center position in the direction of width of the ejection opening, together with the guide surface 25.

The ratchet member 23 is turnably urged by a spring 27 interposed between the member 23 and a spring receiving portion 17*a*, which is formed in the nose top 17, so that the guide surface 25 and the cylindrical surface 26 are disposed in the ejection opening 16 of the nose top 17. When the driver 5 having hammered a nail goes into the ejection opening 16, the ratchet member 23 contacts with the head portion of a nail or with the driver 5 and is turned to retreat from the ejection opening 16. A stopper 28 formed on the front surface of the spring receiving portion 17*a* abuts against the back surface of the ratchet member 23 to thereby regulate the turn of the ratchet member 23 at a position at which the cylindrical surface 26 is flush with the inner wall surface of the ejection opening 16.

The guide surface 25 is formed as a contact surface, which contacts with the driver 5 that is impactively driven in the ejection opening 7 and which causes the ratchet member 23 to turn. Thus, an acute angle of the guide surface 25 with respect to an axis line of the ejection opening 16 is set to be as small as possible. Consequently, impact on the ratchet member 23, which is caused by contacting with the driver, is reduced as much as possible to thereby prevent the ratchet member 23 from being damaged by the impact. The cylindrical surface 26 is formed at the bottom portion of the ratchet member 23 in a state, in which the turn of the ratchet member 23 is regulated, as a surface extends continuously from the inner peripheral surface of the ejection opening 16. Consequently, the head portion of the nail hammered by the driver 5 can surely be guided into the ejection opening 16.

Hereinafter, an operating state of the aforementioned embodiment is described with reference to FIGS. 4 and 5. When a nail N supplied into the ejection opening 7 of the nose portion 8 is hammered out therefrom by the driver 5, the nail N is put into a state in which the head portion of the nail N is tilted rearwardly by the resistance caused by the disconnection of this nail N from the subsequent one of the connected nails, as indicated by solid lines in FIG. 4. The tip end portion of the nail N hammered out by being rearwardly tilted contacts with the slope 24 of the ratchet member 23 provided in the nose top 17. Then, the tip end portion of the nail N is guided along this slope 24 to the direction of the inside of the ejection opening 16 of the nose top 17. The tip end portion of the nail N is subsequently guided by the guide surface 25, which is formed to extend continuously from the slope 24, and the guide groove 25*a* onto the center line in the direction of width of the ejection opening 16.

Figure 4:
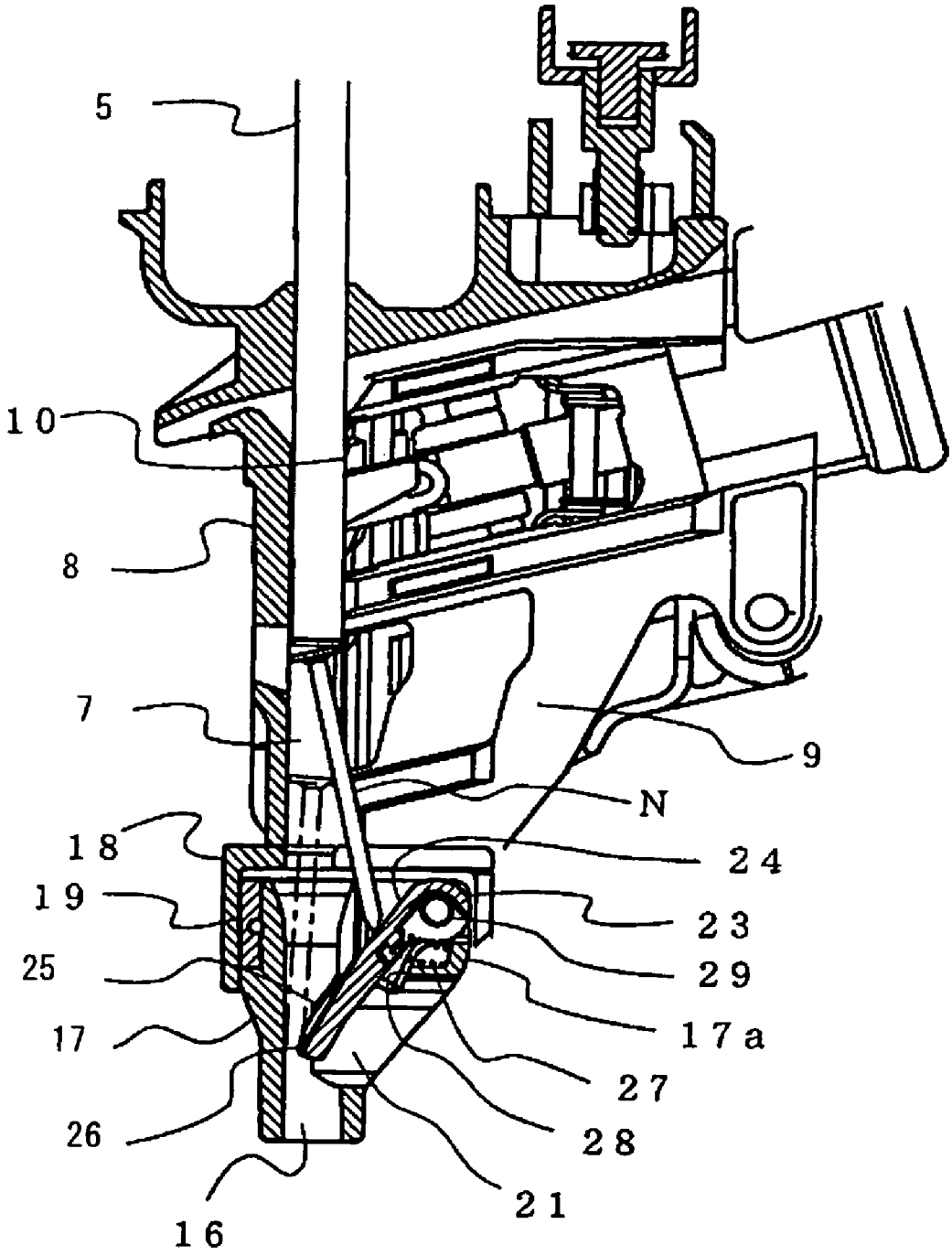
FIG. 4 is a longitudinally cross-sectional view illustrating an initial operating state of a hammering operation of the nailing machine shown in FIG. 1.
Figure 5:
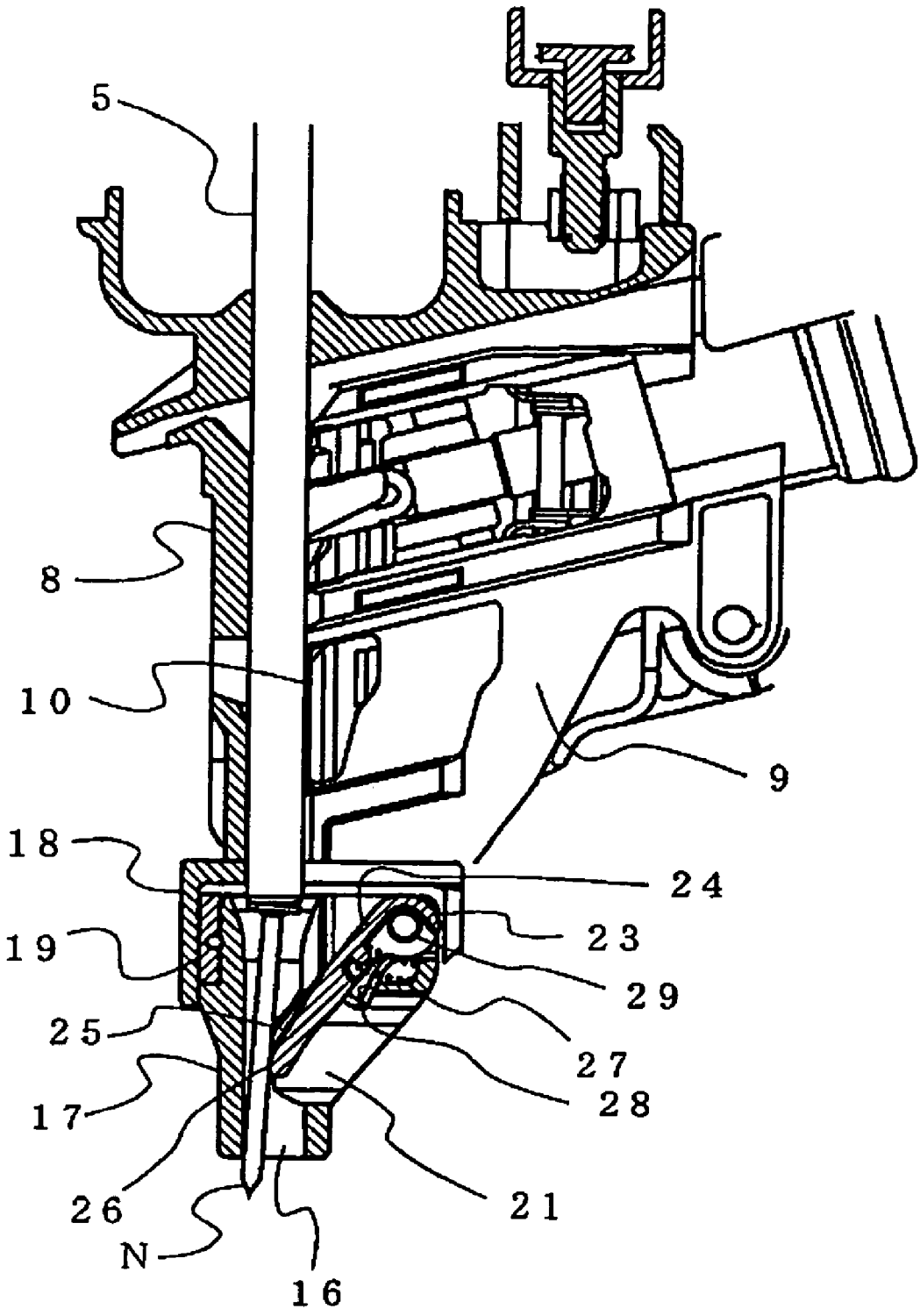
FIG. 5 is a longitudinally cross-sectional view illustrating an operating state of the nailing machine shown in FIG. 1, in which the hammering operation further proceeds.

Then, the tip end portion of the nail N is guided along the guide surface 25 of the ratchet member 23 to the front inner wall surface of the ejection opening 16, as indicated by dot-dash-lines in FIG. 4. The shank of the nail N is pressed against the front wall surface of the ejection opening 16 by the cylindrical surface 26 formed at the end of the ratchet member 23. Thus, the nail N is hammered out from the ejection opening 16 in a inclined state in which the tip end portion of the nail N is pushed against the front inner wall surface of the ejection opening 16 and is rearwardly inclined, as shown in FIG. 5.

Figure 6:
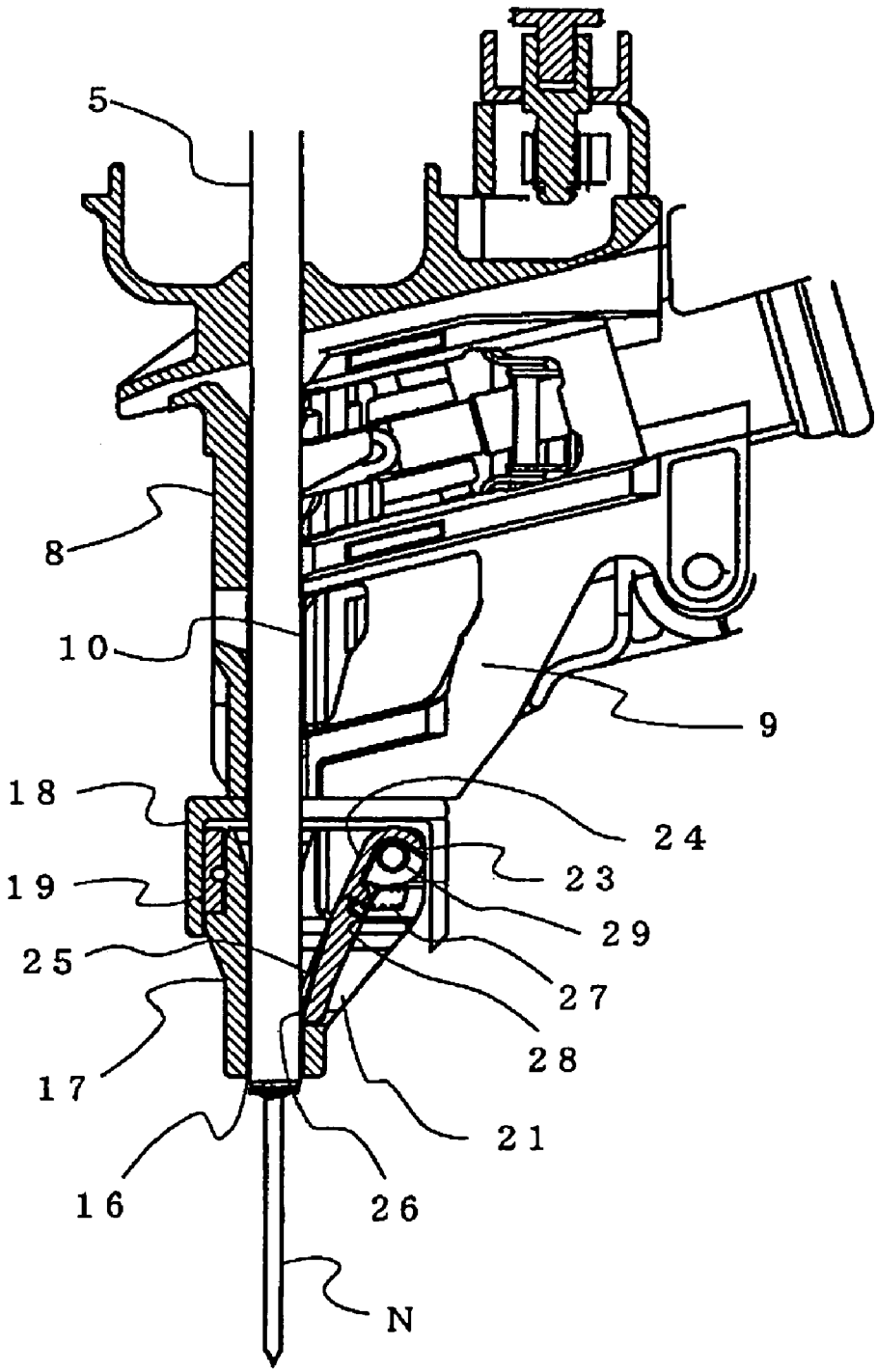
FIG. 6 is a longitudinally cross-sectional side view illustrating an operating state of the nailing machine shown in FIG. 1, in which the hammering operation is completed.
Figure 7:
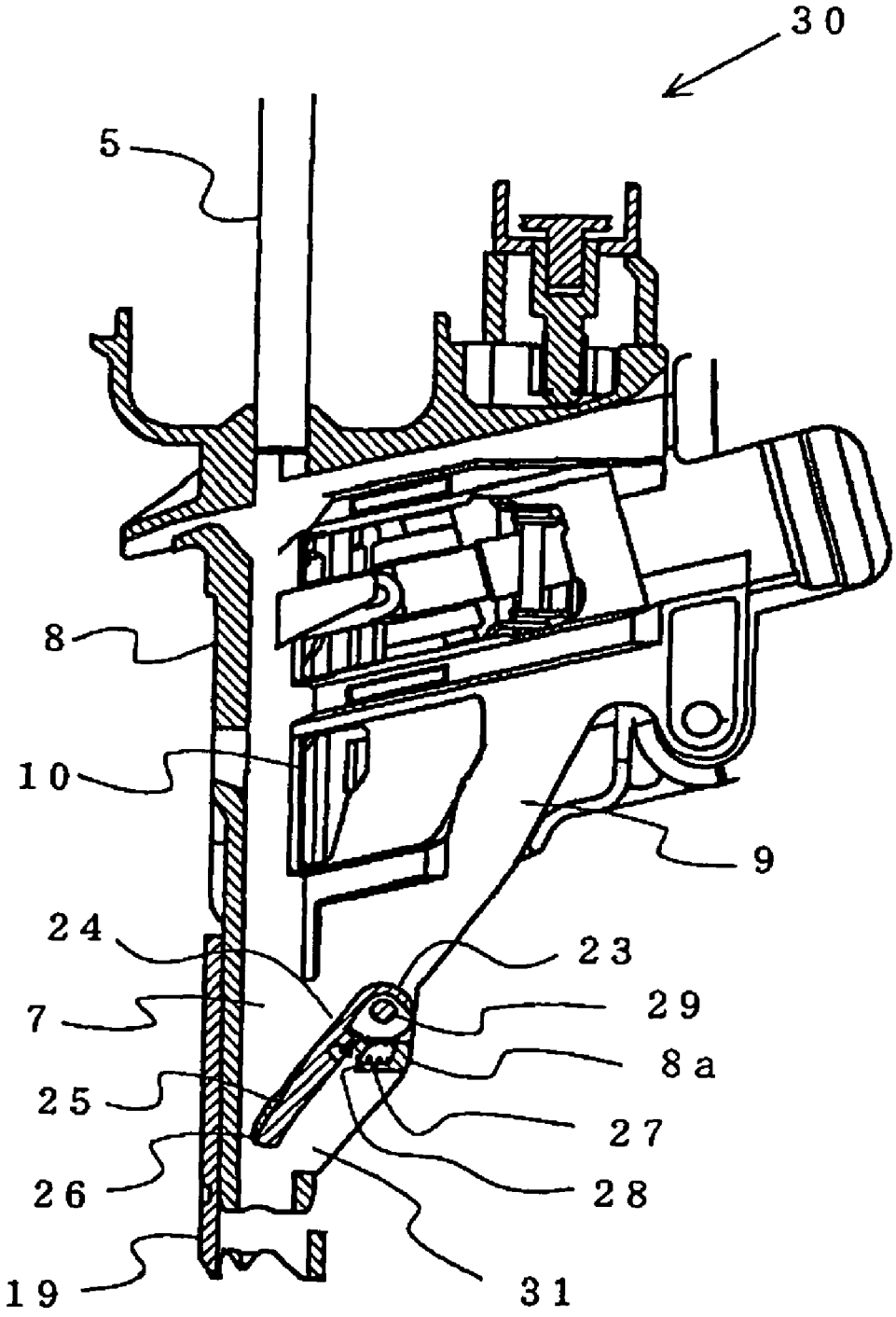
FIG. 7 is a longitudinal cross-sectional view of a primary part of a nailing machine according to a second embodiment of the invention.

The driver 5 driven by the hammering piston 6 hammers the head portion of the nail N, so that a hammering operation proceeds. Then, the head portion of the nail N and the driver 5 contact with the guide surface 25 of the ratchet member 23, which is made by the turning and pushing force of the spring 27 to enter the ejection opening 16. Subsequently, the ratchet member 23 is turned against the pushing force of the spring 27 to thereby retreat the guide surface 25 and the cylindrical surface 26, which have entered the ejection opening 16, from the ejection opening 16. Then, the nose portion 8 of the nailing machine 1 is frontwardly moved by a reaction caused when the hammering piston 6 is driven and the driver 5 hammers out the nail from the ejection opening. The head portion of the nail N, which is under a hammering process, is pressed frontwardly. Thus, as shown in FIG. 6, the nail is hammered in a substantially vertical position into a member to be nailed.

Second Embodiment

Next, a nailing machine, in which a nail hammering guide mechanism is implemented, according to another embodiment of the invention is described hereinbelow. A nailing machine 30 according to this embodiment is adapted so that a nail N is hammered directly into a member, which is to be nailed, from an end of an ejection opening 7 formed in a nose portion 8. This nailing machine 30 is configured so that a ratchet member 23 is turnably supported on side wall 31 formed in the rear of the nose portion 8, in which the ejection opening 7 is formed. Similarly to the aforementioned embodiment, on the ratchet member 23, the following surfaces 24, 25, and 26 are formed to extend continuously and downwardly. That is, a slope 24 is formed flat so as to contact with a tip end of a nail, which is rearwardly inclined in the ejection opening 7 and hammered therefrom, and to guide the tip end portion of this nail into the ejection opening 7 of the nose portion 8. A guide surface 25 is formed like a circular conical surface, which guides the tip end and the shank of a nail to the center position in the direction of width of the ejection opening 7 of the nose portion 17. Also, a cylindrical surface 26 is formed to be the same as that of the ejection opening 7.

The ratchet member 23 is turnably urged by a spring 27 interposed between the member 23 and a spring receiving portion 8*a*, which is formed between side walls 31, so that the guide surface 25 and the cylindrical surface 26 enter the ejection opening 7. The ratchet member 23 is adapted to contact with the head portion of a nail or with the driver 5 and is thus enabled to retreat from the ejection opening 16.

Figure 8:
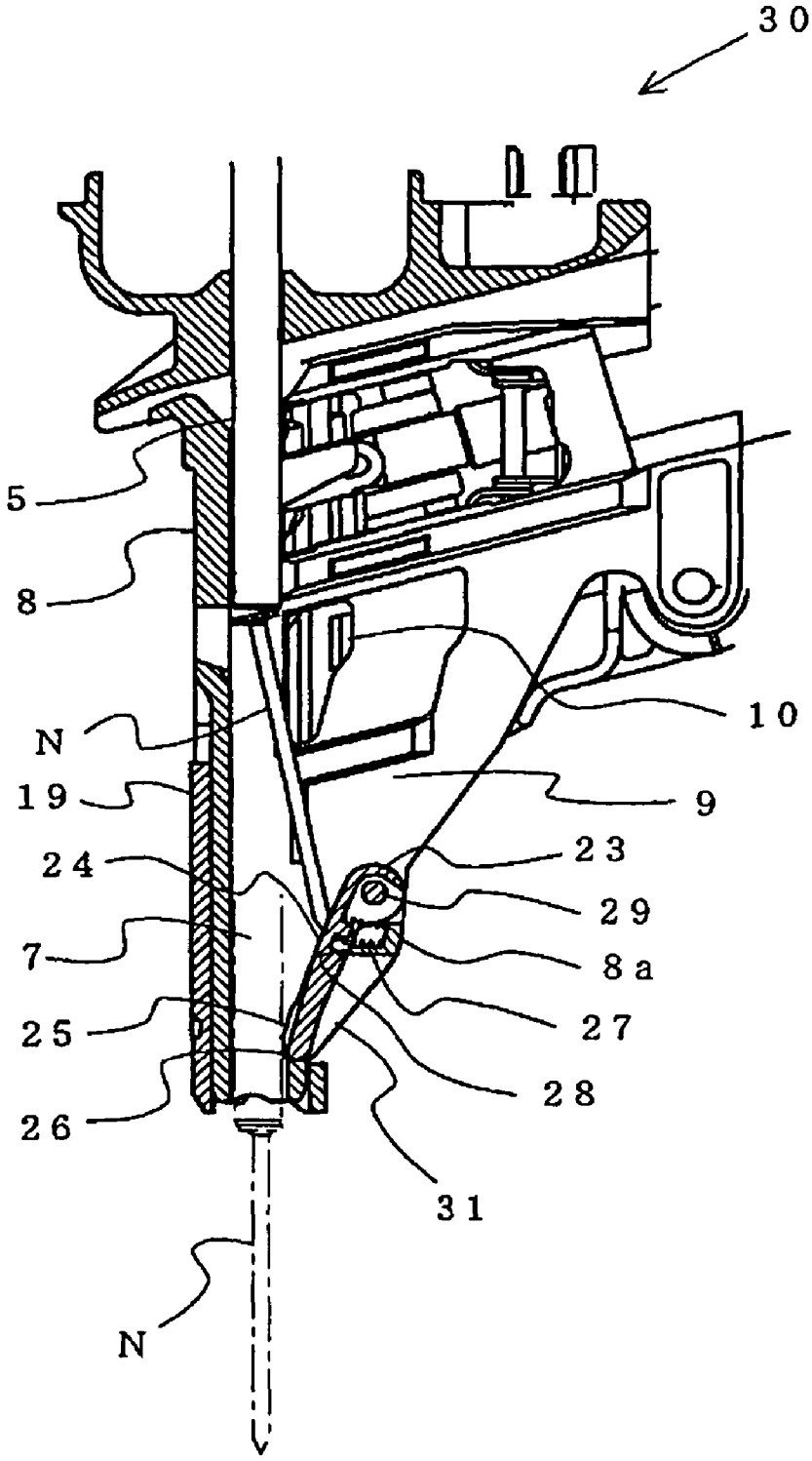
FIG. 8 is a longitudinally cross-sectional view illustrating an operating state of a hammering operation of the nailing machine shown in FIG. 7.

An operation of the nailing machine according to the second embodiment is described hereinbelow with reference to FIG. 8. The tip end portion of the nail N, which is hammered out by the driver 5 so that the tip end portion thereof is rearwardly tilted, contacts with the slope 24 of the ratchet member 23 and is guided along this slope 24 into the direction of the ejection opening 7 of the nose portion 8. Then, the tip end portion of the nail N is guided onto the center line in the direction of width of the ejection opening 7. Further, the shank of the nail N is pressed by the cylindrical surface 26 formed at the end of the ratchet member 23, which is urged by the spring 27. Thus, the tip end portion of the nail N is pushed against the front inner wall surface of the ejection opening 7. Then, the nail N is hammered out in an inclined state, in which the head portion of the nail N is rearwardly inclined, from the ejection opening 7. Thus, the nail N is hammered in a substantially vertical position into a member to be nailed. When an operation of hammering the nail N proceeds, the head portion of the nail N and the driver 5 contacts with the guide surface 25 of the ratchet member 23 and cause the ratchet member 23 to turn against the pushing force of the spring 27. Thus, the head portion of the nail N and the driver 5 retreat the ratchet member 23 from the ejection opening 7.

Third Embodiment

Figure 9:
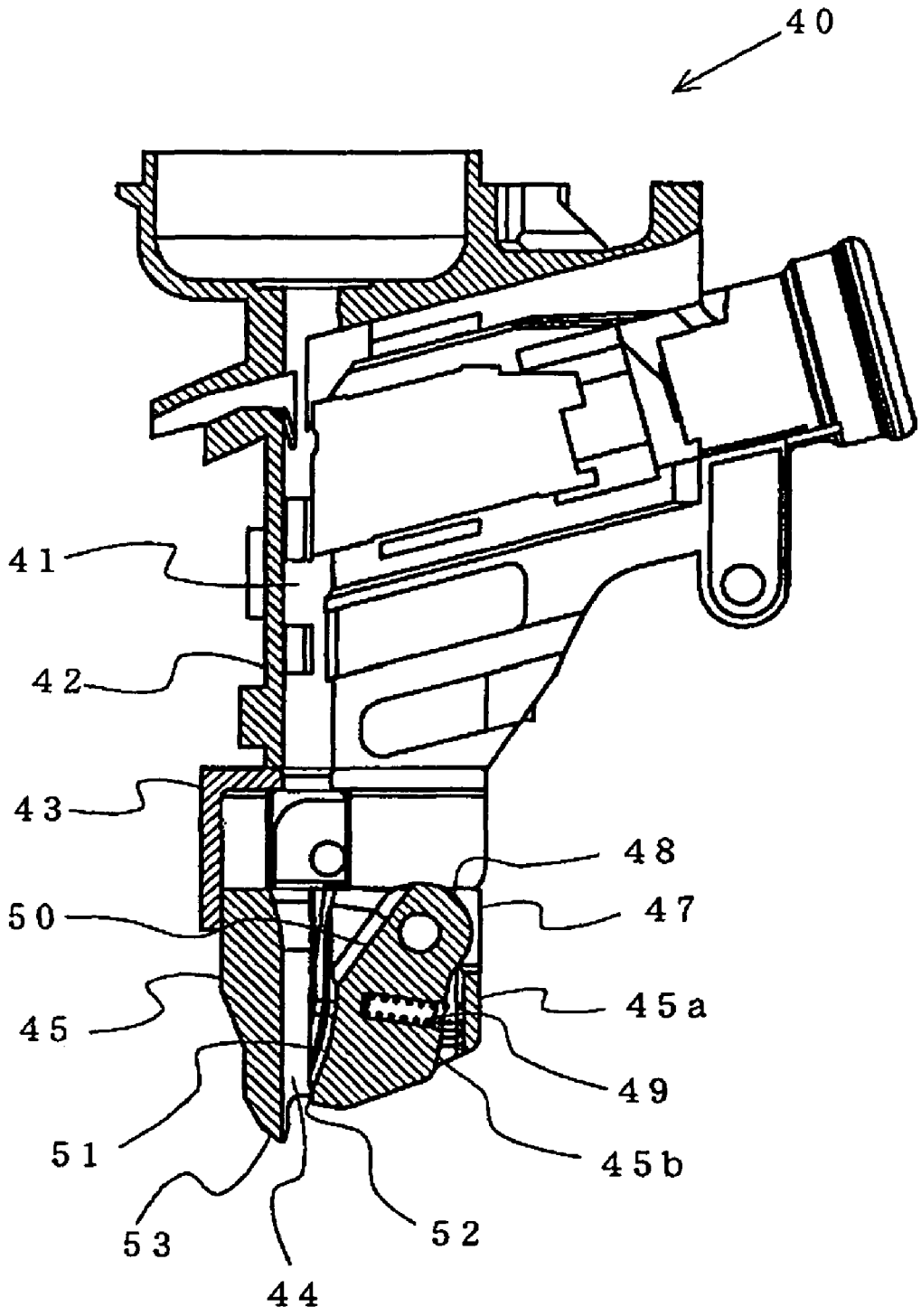
FIG. 9 is a longitudinal cross-sectional view of a primary part of a nailing machine according to a third embodiment of the invention.
Figure 10:
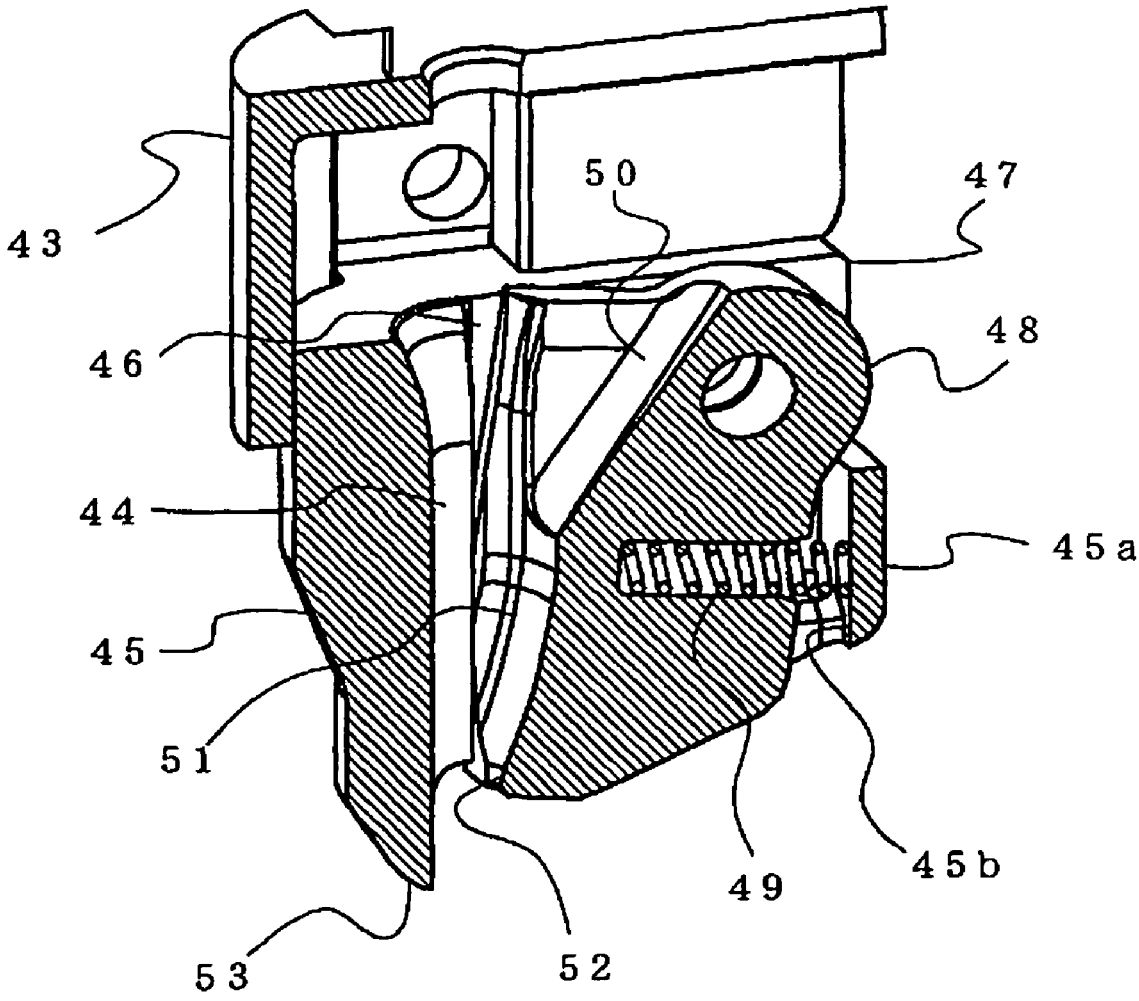
FIG. 10 is a partially cross-sectional perspective view of the primary part shown in FIG. 9.

Next, a nailing machine according to still another embodiment shown in FIGS. 9 and 10 is described hereinbelow. As shown in FIG. 9, a nailing machine 40 according to this embodiment is used when a metal building member used to reinforce a fixing portion between woods is implemented. The nailing machine 40 is adapted to hammer nails into nail holes preliminarily formed in the metal building member. In this nailing machine 40, a contact holder 43 is formed integrally with the bottom of a nose portion 42. A nose top 45, in which the ejection opening 44 is aligned with the ejection opening 41 of the nose portion 42 is provided by being supported by the contact holder 43 slidably along a direction in which a nail is hammered out.

An opening 46 opened rearwardly is formed in a rear side of the ejection opening 44 of the nose top 45. Side walls 47 are formed along and on both sides of the opening 46. A ratchet member 48, which is adapted so that a nail hammered out from the ejection opening 41 of the nose portion 42 between both the side walls 47 is guided into the ejection opening 44 of the nose top 45 and that the shank of the nail is pressed against a front wall of the ejection opening 44, is provided by being turnably supported at the top portion thereof by both the side walls 47. The ratchet member 48 is turnably urged by a spring 49 interposed between the member 48 and a spring receiving portion 45*a* formed on the nose top 45 and is held in an inclined state so that the bottom portion thereof can enter the ejection opening 44 of the nose stop 45 through the opening 46.

As shown in FIG. 10, on the top surface of the ratchet member 48, the following surfaces 50, 51, and 52 are formed to extend continuously and downwardly. That is, a slope 50 is formed flat so as to contacts with a tip end of a nail, which is rearwardly inclined in the ejection opening 41 of the nose portion 42 and hammered therefrom, and to guide the tip end portion of this nail into the ejection opening 44 of the nose top 45. A guide surface 51 is formed like a circular conical surface, which guides the tip end and the shank of a nail to the center position in the direction of width of the ejection opening 44 of the nose top 45. Also, a cylindrical surface 52 is formed to be the same as that of the ejection opening 44.

The ratchet member 48 is turnably urged by a spring 49 so that the guide surface 51 and the cylindrical surface 52 enter the ejection opening 44. When the driver having hammered a nail enters the ejection opening 44, the ratchet member 48 contacts with the head portion of a nail or with the driver 5 and retreats from the ejection opening 44. A stopper 45*b* formed on the front surface of the spring receiving portion 45*a* abuts against the back surface of the ratchet member 48 to thereby regulate the turn of the ratchet member 48 at a position at which the cylindrical surface 52 is flush with the inner wall surface of the ejection opening 44.

A guide projection 53 used to position and guide the nose top 45 to a nail hole formed in a metal building member is formed at the bottom portion of the nose top 45, in which the ejection opening 44 is formed. The guide projection 53 is formed by downwardly protruding the front inner wall surface of the nose top 45, in which the ejection opening 44 is formed. The outer peripheral surface of the guide projection 53 is formed like a circular conical surface. An end portion of the guide projection 53 is formed to be tapered off so that the end portion thereof can be inserted into a nail hole formed in the metal building fitting. The shank of the nail hammered out from the ejection opening 44 is pushed against the front wall surface in the ejection opening 44 by the cylindrical surface 52 formed at the bottom portion of the ratchet member 48 turnably pressed by the spring 49. A nail in a state, in which the tip end portion of the nail is in contact with the inner peripheral surface of the guide projection 53, is hammered into the nail hole formed in the meal building fitting from the ejection opening 44.

Figure 11:
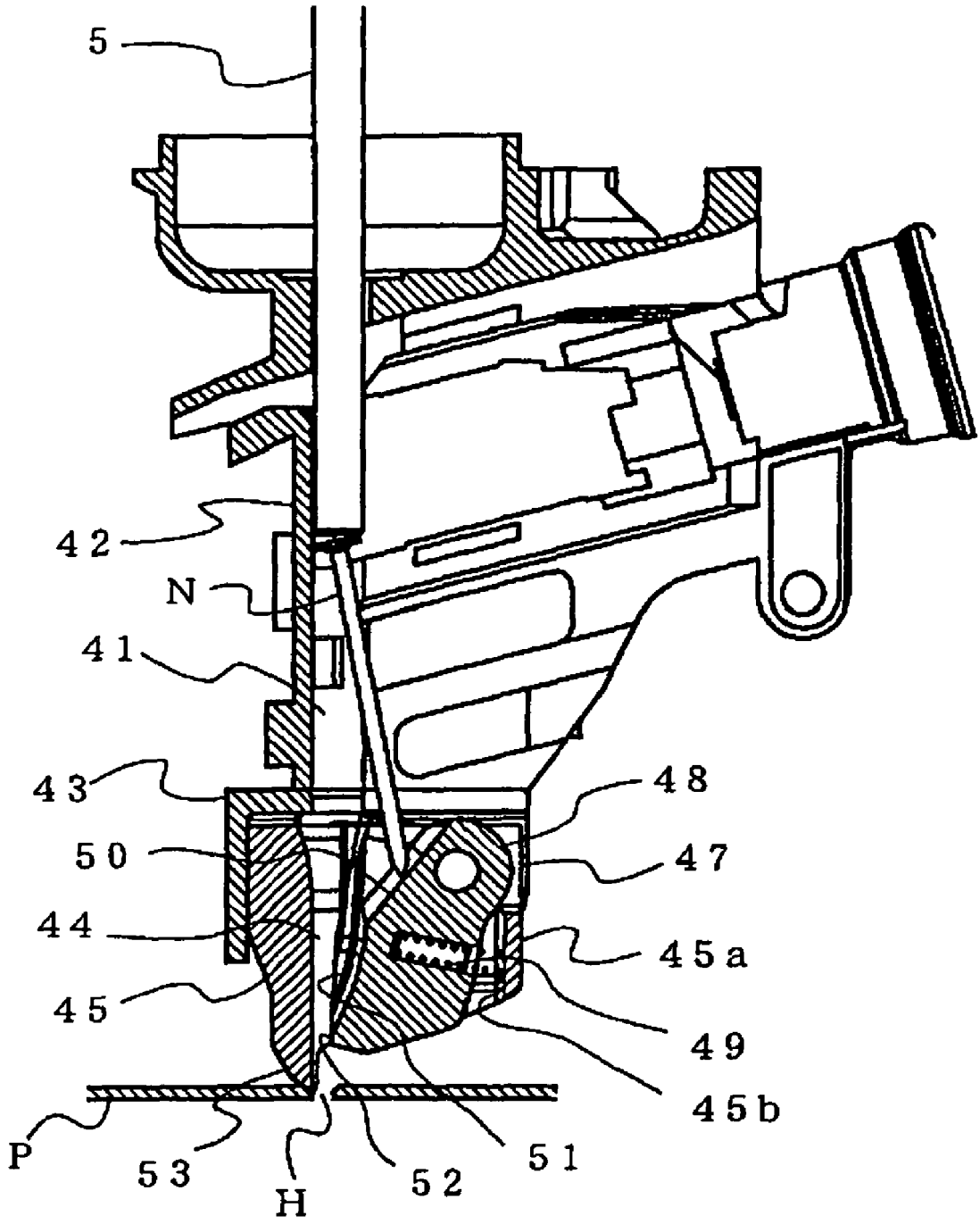
FIG. 11 is a longitudinally cross-sectional view illustrating an initial operating state of a hammering operation of the nailing machine shown in FIG. 9.

Hereinafter, an operating state caused by the nailing machine according to the third embodiment is described with reference to FIGS. 11 to 13. The tapered end portion of the guide projection 53, which is formed at the end of the nose top 45, is inserted into a nail hole H of the meal building fitting P. Then, the nose top 45 is upwardly moved with respect to the nose portion 42 by pressing the nailing machine 40 against a member to be nailed. Further, the nailing machine is activated by operating the trigger lever. Then, the driver 5 hammers out a nail N, which is supplied in the ejection opening 41 of the nose portion 42, from the ejection opening 41. As shown in FIG. 11, the tip end portion of the nail N, which is rearwardly inclined when the nail N is hammered out from the ejection opening 41 of the nose portion 42, contacts with the slope 50 of the ratchet member 48 and is thus guide along the slope 50 to the ejection opening 44 of the nose top 45.

Figure 12:
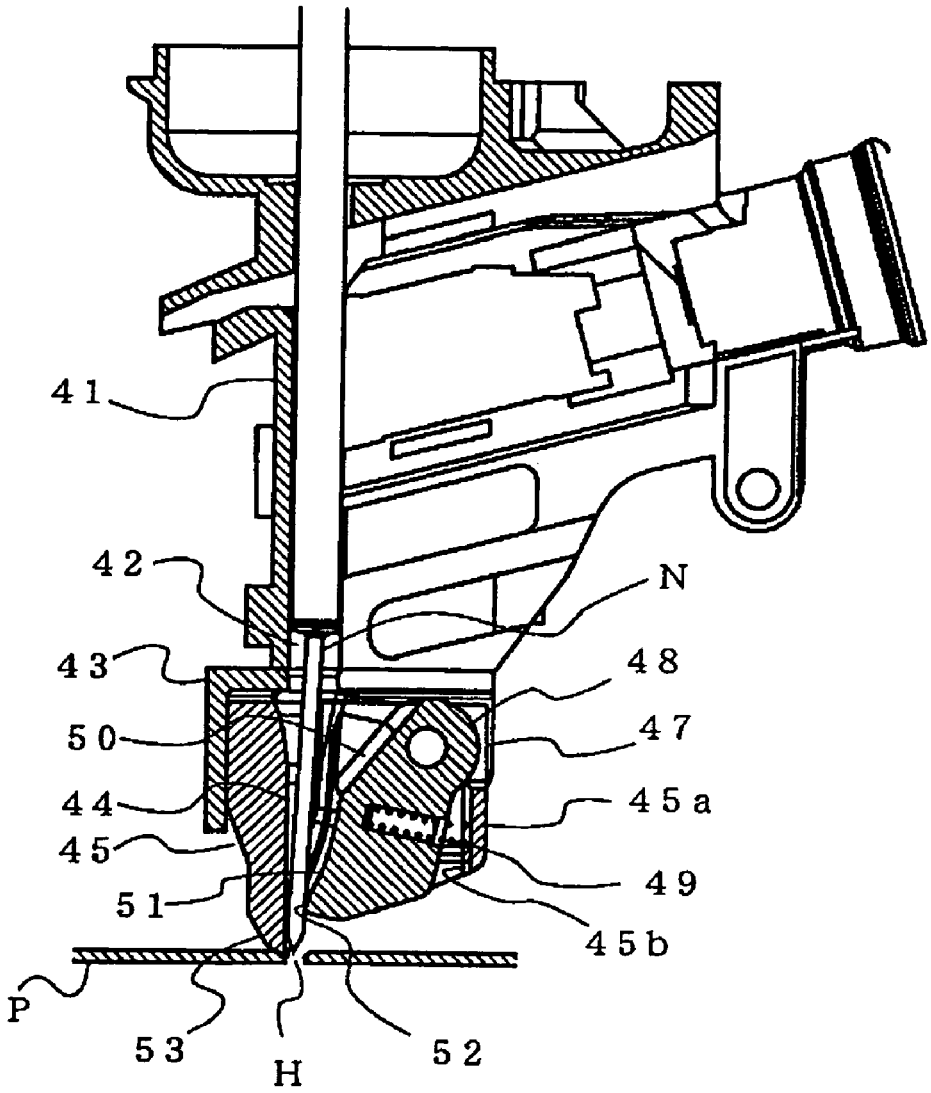
FIG. 12 is a longitudinally cross-sectional view illustrating an operating state of the nailing machine shown in FIG. 9, in which the hammering operation further proceeds.
Figure 13:
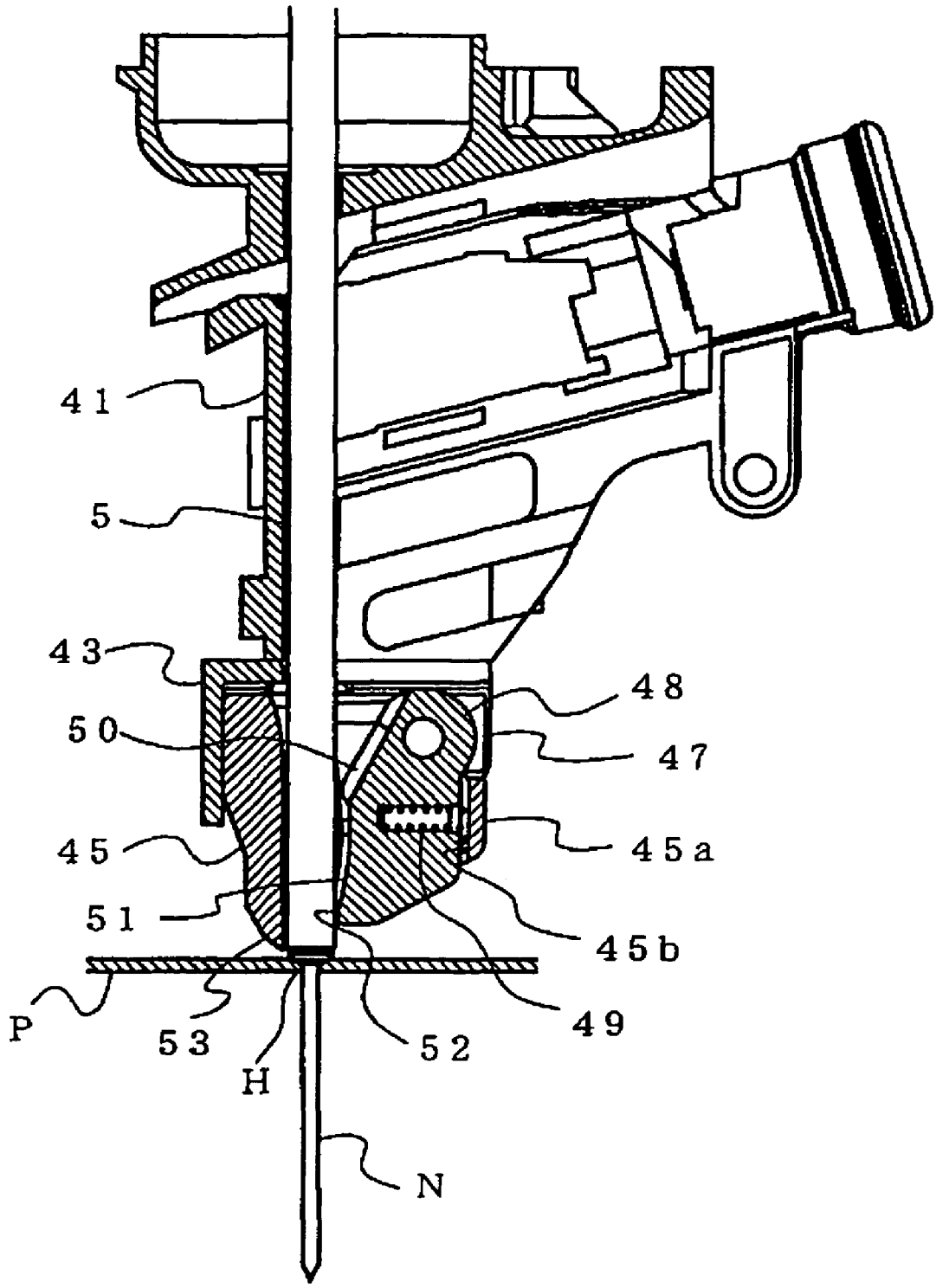
FIG. 13 is a longitudinally cross-sectional side view illustrating an operating state of the nailing machine shown in FIG. 9, in which the hammering operation is completed.

As shown in FIG. 12, the shank of the nail N guided into the ejection opening 44 of the nose top 45 contacts with the cylindrical surface 52 formed at the end portion of the ratchet member 48. Then the shank of the nail is pressed against the front inner wall surface of the ejection opening 44 by the ratchet member 48 which is turnably urged by the spring 48. Consequently, the tip end portion of the nail N is pressed against the front wall surface of the ejection opening 44, and the nail N is hammered out along the inner wall surface of the guide projection 53 from the ejection opening 44. As shown in FIG. 13, the nail N is hammered into the nail hole H of the metal building member P, into which the end portion of the guide projection is inserted.

Incidentally, in the third embodiment, the ratchet member 48 is formed in the nose top 45 slidably supported by the nose portion 42. The guide projection 53, which can be inserted into the nail hole of the metal building fitting, is formed at the bottom of the nose top 45. However, similar advantages can be obtained by forming the ratchet member 48 turnably in the nose portion 42, in which the ejection opening 41 is formed, and also forming the guide projection 53, which can be inserted into the nail hole of the metal building fitting, at the bottom of the nose portion 42.

Although the guide projection 53 is integrally provided in the nose top 45, a separate guide projection may be detachably provided at the end portion of the nose top 45. In this case, when the guide projection is detached from the end portion of the nose top 45, the nailing machine can be used for general purposes.

In any of the aforementioned embodiments, the guide groove 25*a* is formed in the top portion of the guide surface 25. However, the tip end portion of the nail can be guided to each of the center of the ejection openings 7 and 16 by using only the guide surface 25.

Fourth Embodiment

Figure 14:
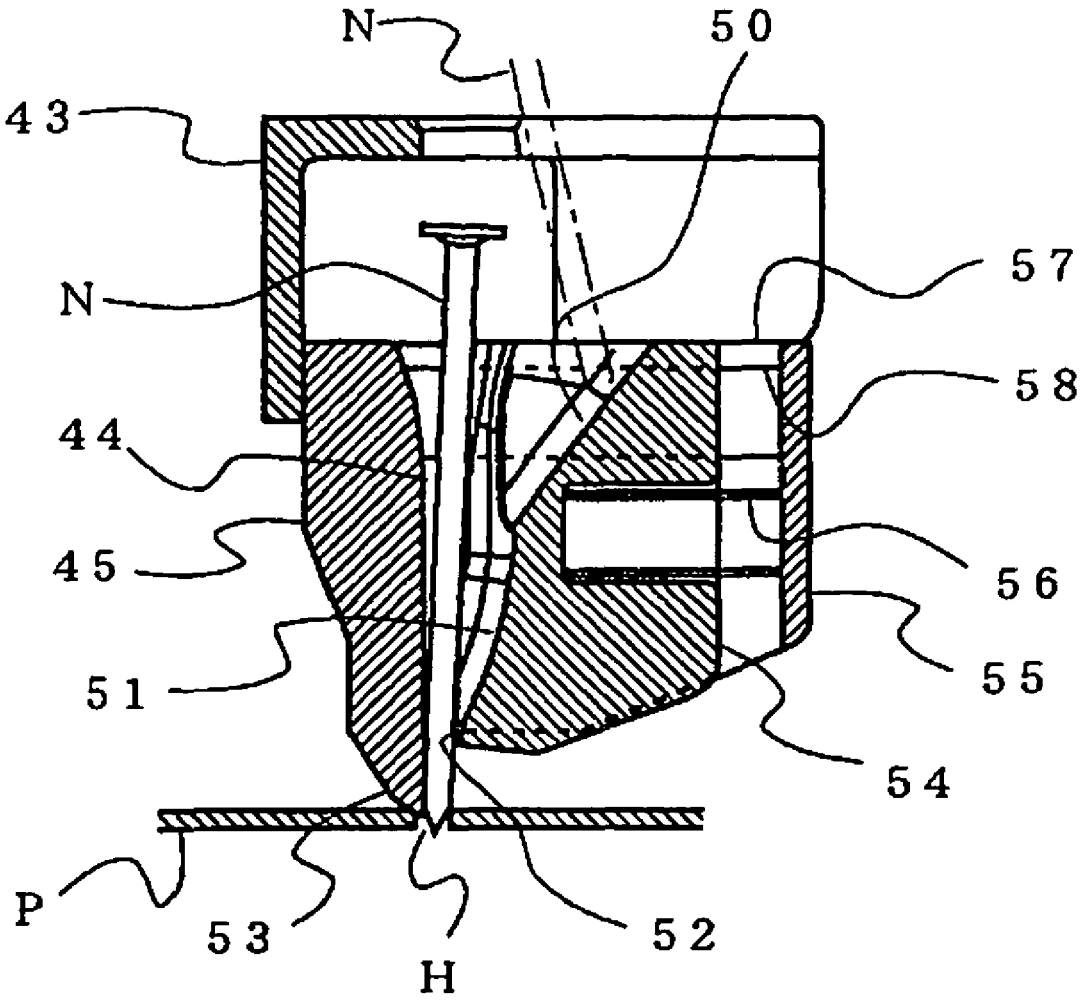
FIG. 14 is a longitudinal cross-sectional view of a nail hammering guide mechanism according to a fourth embodiment of the invention.

Although the ratchet member 23 is turnably supported at the top portion thereof by the nose portion or the nose top 17 or 45, the nailing machine may be configured, according to another embodiment as shown in FIG. 14, so that the ratchet member 54, in which the slope 50, the guide surface 51 and the cylindrical surface 52 are formed, is supported with respect to the nose top 45 slidably in a direction perpendicular to the ejection opening 44, and that the ratchet member 54 is urged in a sliding direction by a spring 56 interposed between the member 54 and a spring receiving portion 55 formed in the nose stop 45 so that the guide surface 51 and the cylindrical surface 52, which are formed in the ratchet member 54, enter the ejection opening 44.

Figure 15:
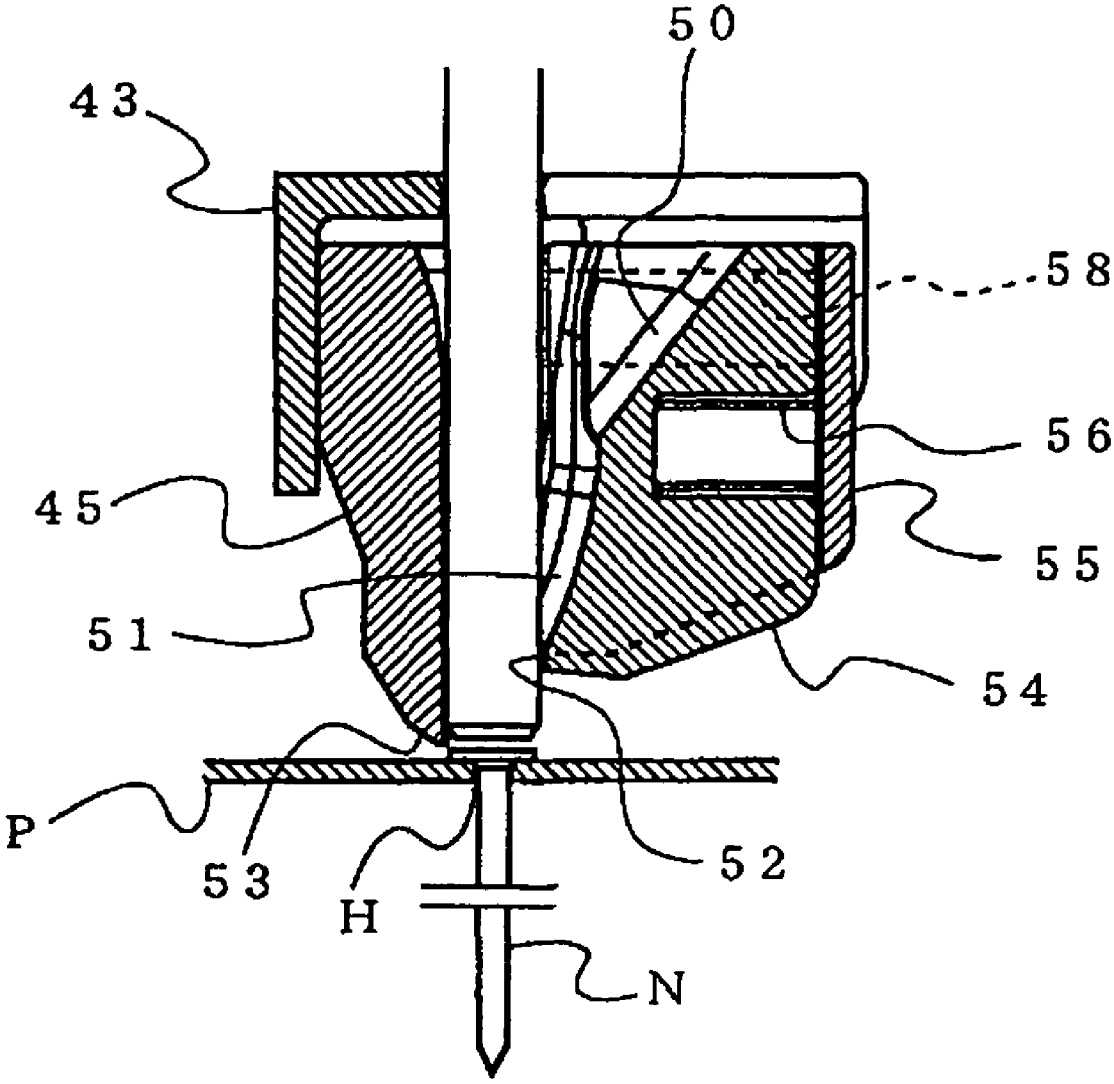
FIG. 15 is a longitudinally cross-sectional view illustrating an operating state of the nail hammering guide mechanism shown in FIG. 14.

The ratchet member 54 configured in this way guides the tip end portion of a nail, which is hammered out by being inclined to the rear side of the nose portion, into the ejection opening 44 through the use of the slope 50. Also, the ratchet member 54 causes the tip end portion of the nail to be placed along the guide projection 53. When the driver 5 hammers a nail, the ratchet member 54 is slide-moved along a guide groove formed between the side wall 57 of the nose top 45 and the ratchet member 54 so that the guide surface 51 contacts with the driver 5 or with the head portion of the nail and causes the guide surface 51 and the cylindrical surface 52 to retreat from the inside of the ejection opening 44, as shown in FIG. 15. Additionally, the structure supporting the ratchet member is not limited to these structures. Any structure may be employed, as long as the structure is adapted to contact, when the driver 5 enters the ejection opening 7 or 16, with the head portion of a nail or with the driver 5 and to rearwardly retreat from the ejection opening 7 or 16.

Fifth Embodiment

Next, still another embodiment of the invention shown in FIGS. 16(*a*) to 16(*c*) is described hereinbelow. In this embodiment, the nose top 45, in which the ejection opening 44 is formed, is provided by being supported by the contact holder 43 slidably along a direction, in which a nail is hammered out, with respect to the main body of the nailing machine. An opening 46 opened to the rear side is formed in the rear of the ejection opening 44. Side walls 47 are formed along both sides of this opening 46, respectively. A ratchet member 60 serving to guide a nail, which is hammered out from the nose portion of the main body of the nailing machine, into the ejection opening 44 of the nose top 45 and to push the shank of the nail against the front wall of the ejection opening is provided by being turnably supported between both of these side walls 47 turnably around a support shaft 61.

In the ratchet member 60, an upper slope 62 and a lower slope 63 are formed to extend linearly and continuously. The upper slope 62 contacts with the tip end portion of a nail hammered out in a state, in which the tip end portion of the nail is inclined rearwardly, from the ejection opening of the main body of the nailing machine to thereby guide the tip end portion of the nail into the ejection opening 44. Further, the lower slope 63 guides the tip end portion of a nail to the front wall surface of the ejection opening 44 and places the shank of the nail to be along the inner surface of a front wall. When the ratchet member 69 is turned around the support shaft 61, the lower slope 63 enters and exits the ejection opening 44 through the opening 46 formed in the ejection opening 44. The upper slope 62 is always disposed in the rear of the ejection opening 44. The ratchet member 60 is held in an inclined state in which the ratchet member 60 is turnably urged by a spring 64 interposed between the member 60 and a spring receiving portion 45*a*, which is formed in the nose top 45, top enable the lower slope 63 to enter the ejection opening 44 through the opening 46.

Figure 16A:
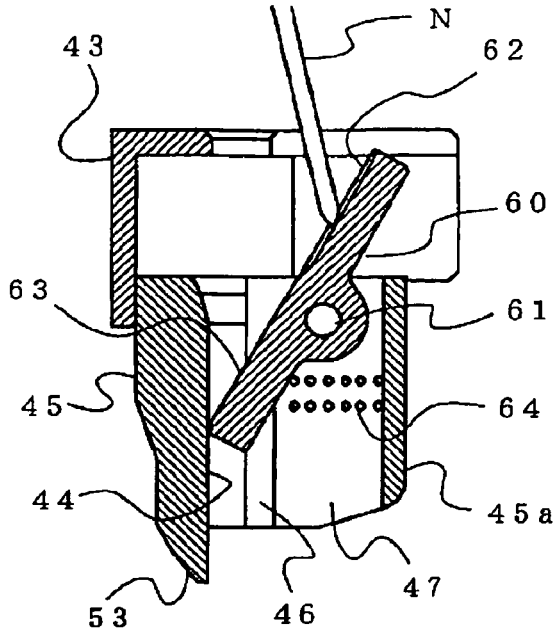
FIGS. 16(*a*) to 16(*c*) are longitudinal cross-sectional views of a primary part of a nailing machine according to a fifth embodiment of the invention.
Figure 16B:
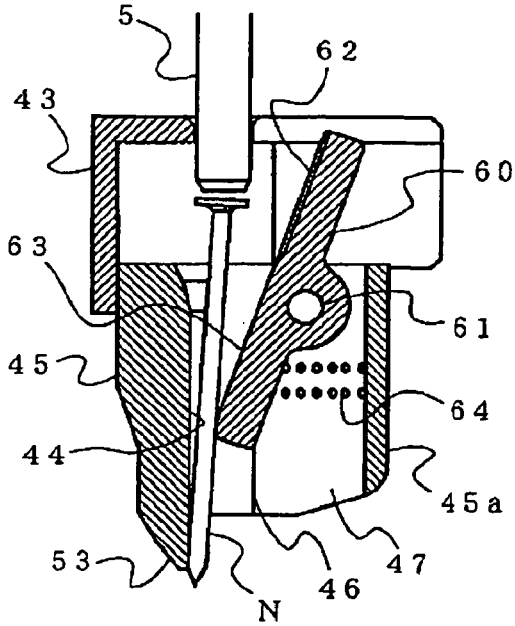
Figure 16C:
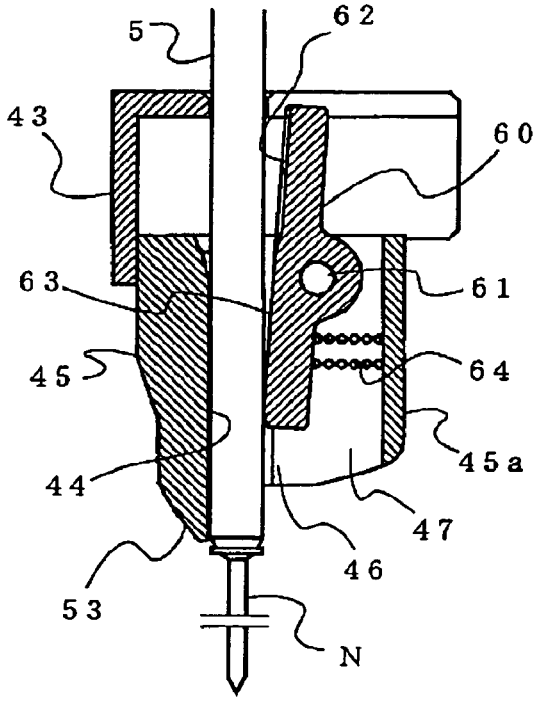

As shown in FIG. 16(*a*), the tip end portion of a nail N hammered out in a state, in which the tip end portion of the nail N is rearwardly inclined, from the nose portion of the main body of the nailing machine contacts with the upper slope 62 of the ratchet member 60 and is guided into the ejection opening 44 of the nose top 45. Further, the tip end portion of the nail N guided into the ejection opening 44 is guided to the front wall surface of the ejection wall 44. Then, as shown in FIG. 16(*b*), the bottom portion of the lower slope 63 presses the shank of the nail N against the front wall surface of the ejection opening 44 and guides the tip end portion of the nail N so that the nail N is hammered out along the front wall surface of the ejection opening 44. Furthermore, when the nail N is hammered by the driver 5, the head portion of the hammered nail N or the driver 5 contacts with the lower slope 63 of the ratchet member 60, as shown in FIG. 6(*c*). Consequently, the ratchet member 60 is turned, so that the lower slope 63 is retreated from the ejection opening 44. Thus, the nail N can be hammered along the guide projection 53 formed at the bottom of the nose top 45. Consequently, a nail can be surely hammered into a nail hole formed in a metal building fitting.

Sixth Embodiment

Figure 17A:
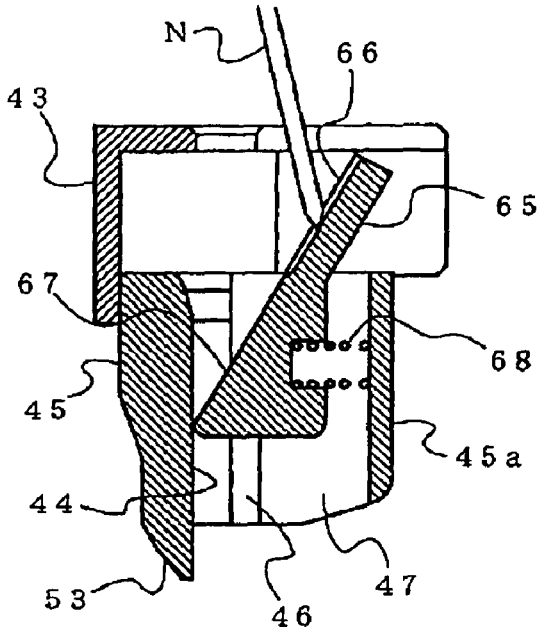
FIGS. 17(*a*) to 17(*c*) are longitudinal cross-sectional views of a primary part of a nailing machine according to a sixth embodiment of the invention.
Figure 17B:
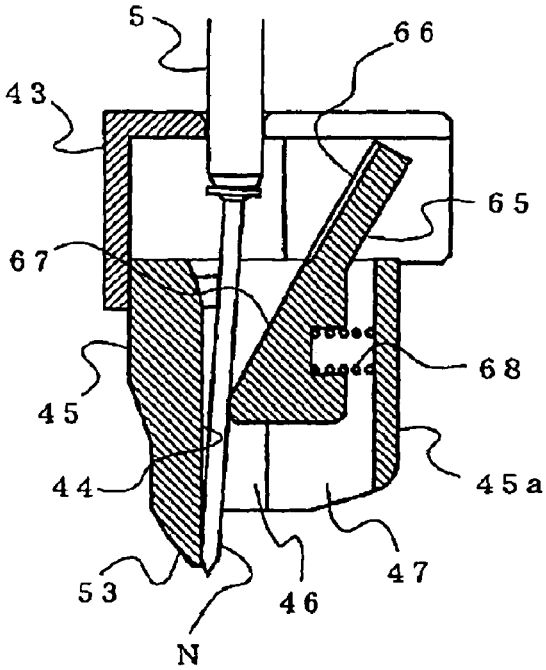
Figure 17C:
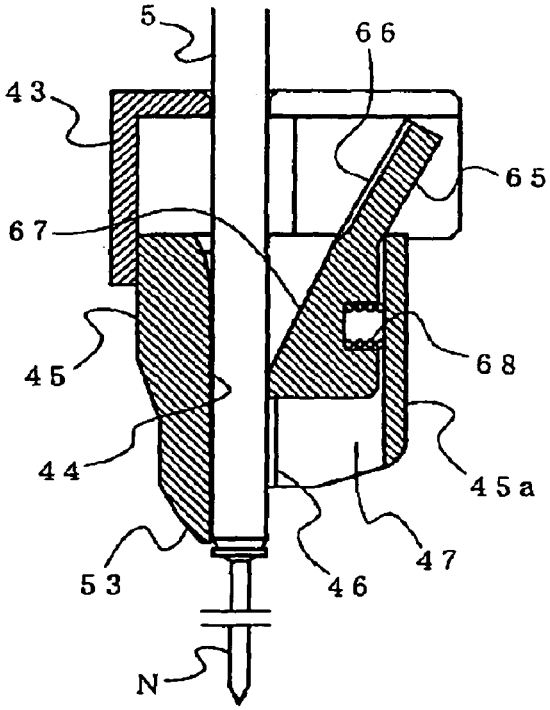

FIGS. 17(*a*) to 17(*c*) show a still another embodiment. Similarly to the embodiment shown in FIGS. 16(*a*) to 16(*c*), a ratchet member 65 of a sixth embodiment has an upper slope 66 and a lower slope 67, which are formed to extend linearly and continuously. The upper slope 66 guides the tip end portion of a nail, which is hammered out by being inclined rearwardly, into an ejection opening 44. The lower slope 67 guides the tip end portion of the nail to a front wall surface of the ejection opening 44 and places the shank of the nail along the inner surface of the front wall of the ejection opening 44. The ratchet member 65 is supported between side walls 47 formed along both sides of an opening 46, which is formed in the rear of the ejection opening 44 of a nose top 45, slidably in a direction perpendicular to an axial line of the ejection opening 44. The ratchet member 65 is slidably urged by a spring 68 interposed between the member 65 and a spring receiving portion 45*a* formed in the nose top 45 so that the lower slope 67 can enter the ejection opening 44 of the nose top 45 through the opening 46.

As shown in FIG. 17(*a*), the tip end portion of the nail N, which is hammered out by rearwardly inclining the tip end portion thereof, contacts with the upper slope 66 of the ratchet member 65 and is guided into the ejection opening 44 of the nose top 45. Then, the tip end portion of the nail N guided into the ejection opening 44 is guided by the lower slope 67 to the front wall surface of the ejection opening 44. Subsequently, as shown in FIG. 17(*b*), the bottom portion of the lower slope 67 pushes the shank of the nail N against the front wall surface of the ejection opening 44, and guides the nail N so that the tip end portion of the nail N is hammered out along the front wall surface of the ejection opening 44. Furthermore, when the nail N is hammered by the driver 5, the head portion of the hammered nail N or the driver 5 contacts with the lower slope 67 of the ratchet member 65 to thereby cause the ratchet member 65 to rearwardly slide so that the lower slope 67 is retreated from the ejection opening 44, as shown in FIG. 17 (*c*). Consequently, the nail N can be hammered along a guide projection 53 formed at the bottom of the nose top 45. Consequently, a nail can be surely hammered into a nail hole formed in a metal building fitting.

INDUSTRIAL APPLICABILITY

As described above, according to the invention, the ratchet member has the slope adapted to guide the tip end portion of the nail, which is inclined rearwardly from the ejection opening, into the ejection opening, and the guide surface adapted to guide the tip end portion of the nail to the enter of the ejection opening. This ratchet member is formed in the rear of the ejection opening by being urged so that the guide surface of the ratchet member enters the ejection opening. Thus, the nail, which is hammered out in a state in which the tip end portion of the nail is inclined rearwardly, is contacts with the slope and is guided into the ejection opening. Consequently, the nail can be prevented from flying out rearwardly from the nose portion. Also, the shank of the nail is frontwardly pressed by the ratchet member, so that the position of the tip end portion of the nail hammered out from the ejection opening can be limited to the front side of the ejection opening. Thus, a nail can be hammered substantially vertically into a member, which is to be nailed, by a synergistic action with the phenomenon that the nose portion is frontwardly moved by the reaction of hammering the nail.

Further, in a case where the ratchet member is formed in the nose top supported slidably with respect to the nose portion, even when the nose portion is moved vertically upwardly with respect to the member, which is to be nailed, by the reaction caused at the hammering of the nail, the nose top is in contact with the hammering surface of member to be nailed. Thus, the driver can be prevented from making a mark on the surface of the member, which is to be nailed, due to the misalignment of the bottom surface of the driver with the head portion of the nail.

Further, in a case where the ratchet member is formed in the nose portion in which the ejection opening is formed, the shape of the end portion of the ejection opening can be thinned. Thus, reduction in weight and cost of the machine can be achieved.

Moreover, the ratchet member, in which a slope adapted to guide the tip end portion of the nail, which is inclined to the rear side of the ejection opening, into the ejection opening and a guide surface adapted to guide the tip end portion of the nail to the center of the ejection opening are formed, is formed by being urged so that the guide surface of the ratchet member enters the ejection opening. Furthermore, the guide projection, which can be inserted into a nail hole of a metal building fitting, is formed at the front bottom portion of the ejection opening. Thus, the tip end portion of the nail is hammered out along the guide projection. The nailing machine is activated by inserting the guide projection into the nail hole of the metal building fitting. Consequently, a nail can surely be hammered into a nail hole of a metal building fitting.

Furthermore, in the ratchet member, the upper slope adapted to guide the tip end portion of the nail, which is inclined rearwardly from the ejection opening, into the ejection opening, and the lower slope adapted to guide the tip end portion of the nail, which is guided into the ejection opening, to the front inner wall of the ejection opening, are formed to extend continuously. Such a ratchet member is adapted so that the upper slope of the ratchet member is always disposed in the rear of the ejection opening, that the lower slope is configured to be able to enter and exit, and that the ratchet member is formed in the rear of the ejection opening by being pressed so that the lower lope can enter the ejection opening. Thus, a nail, which is hammered out from the nose portion of the main body of the nailing machine by being inclined rearwardly, can be guided by the single ratchet member. Also, a nail can be hammered into a member, which is to be nailed, by guiding the tip end portion of the nail to a front wall surface in the ejection opening and placing the tip end portion of the nail along the front wall surface of the ejection opening. Consequently, the nail can surely be prevented from flying out rearwardly from the nose portion. Also, a nail can surely be hammered into a nail hole of a metal building fitting.

The invention claimed is:

1. A nailing machine comprising:

a driver that is configured to hammer out a nail;

a nose portion having a first ejection opening for slidably guiding the driver;

a contact holder fixed to a lower end of the nose portion, a nose top that is held by the contact holder and slidable with respect to the nose portion and the contact holder along a direction in which the nail is hammered out, wherein the nose top includes a second ejection opening aligned with the first ejection opening of the nose portion;

side walls formed in the nose top on a rear side of the second ejection opening; and a ratchet member, disposed in the nose top and provided between the sidewalls, and including a slope for guiding an end portion of the nail that is inclined toward a rear side of the second ejection opening into the second ejection opening, and a guide surface for guiding the end portion of the nail to a center of the second ejection opening, wherein the ratchet member is urged so that the guide surface of the ratchet member enters into the second ejection opening.

2. The nailing machine according to claim 1, further comprising:

a guide projection, formed at a bottom portion of a front wall of the second ejection opening to project downwardly, and insertable into a metal building fitting, wherein the end portion of the nail is hammered out along the guide projection.

3. The nailing machine according to claim 1, further comprising:

a support shaft fitted between the side walls and penetrating a top portion of the ratchet member; and a spring, wherein the ratchet member is turnable around the support shaft and urged by the spring.

4. The nailing machine according to claim 1, further comprising:

a spring, wherein the ratchet member is slidable and urged by the spring.

5. The nailing machine according to claim 1, further comprising:

a guide groove formed on the guide surface to guide the tip portion of the nail to the center position in the direction of width of the second ejection opening, together with the guide surface.

6. A nailing machine, comprising:

a driver configured to hammer out a nail;

a nose portion having a first ejection opening for slidably guiding the driver;

a contact holder fixed to a lower end of the nose portion;

a nose top that is held by the contact holder and slidable with respect to the nose portion and the contact holder along a direction in which the nail is hammered out, wherein the nose top includes a second ejection opening aligned with the first ejection opening of the nose portion; and a ratchet member disposed in the nose top and including an upper slope for guiding an end portion of the nail that is inclined toward a rear side of the second ejection opening into the second ejection opening and a lower slope for guiding the end portion of the nail guided into the second ejection opening to a front wall of the second ejection opening, wherein the upper slope and the lower slope are continuously formed, wherein the upper slope of the ratchet member is always disposed in a rear side of the second ejection opening, wherein the lower slope is capable of entering and exiting the second ejection opening, is urged in a direction in which the lower slope enters the second ejection opening, and is disposed in the rear side of the second ejection opening, and when the lower slope enters the second ejection opening, the lower slope pushes the nail to a front wall surface of the second ejection opening.

7. The nailing machine according to claim 6, further comprising:

side walls formed in the nose top on a rear side of the second ejection opening, wherein the ratchet member is disposed in the nose top and provided between the side walls.

8. The nailing machine according to claim 6, further comprising:

a support shaft fitted between the side walls and penetrating a top portion of the ratchet member; and a spring, wherein the ratchet member is turnable around the support shaft and urged by the spring.

9. The nailing machine according to claim 6, further comprising:

a spring, wherein the ratchet member is slidable and urged by the spring.

10. The nailing machine according to claim 6, further comprising:

a guide groove formed on a guide surface of the lower slope of the ratchet member to guide the tip end portion of the nail to a center position in a direction of width of the ejection opening, together with the guide surface.

* * * * *